United States Patent [19]

Hira et al.

[11] 4,423,971

[45] Jan. 3, 1984

[54] PRINTER WITH A DOCUMENT GUIDE DEVICE

[75] Inventors: Yutaka Hira, Shizuoka; Shinya Nakamura, Numazu, both of Japan

[73] Assignee: Tokyo Electric Co., Ltd., Tokyo, Japan

[21] Appl. No.: 378,637

[22] Filed: May 17, 1982

[30] Foreign Application Priority Data

May 22, 1981 [JP] Japan ..... 56-74182[U]

[51] Int. Cl.[3] ..... B42J 1/08

[52] U.S. Cl. ..... 400/144.2; 400/536; 400/642

[58] Field of Search ..... 400/144.2, 645.5, 645.4, 400/645.1, 642, 171, 174, 175, 536, 537, 538, 539, 540, 542

[56] References Cited

U.S. PATENT DOCUMENTS

| | | | |
|---|---|---|---|
| 1,151,872 | 8/1915 | Gilfillan | 400/645.4 |
| 1,310,829 | 7/1919 | Hokanson et al. | 400/645.4 |
| 4,049,109 | 9/1977 | Plaza et al. | 400/144.2 |
| 4,049,110 | 9/1977 | Frechette | 197/53 |
| 4,203,675 | 5/1980 | Osmera et al. | 400/144.2 |
| 4,291,993 | 9/1981 | Gagnebin | 400/144.2 |
| 4,310,255 | 1/1982 | Asano et al. | 400/144.2 |
| 4,314,770 | 2/1982 | Harre | 400/144.2 |

*Primary Examiner*—Robert A. Hafer
*Assistant Examiner*—Bradley M. Lewis
*Attorney, Agent, or Firm*—Frishauf, Holtz, Goodman and Woodward

[57] ABSTRACT

A mounting head is used to fix a print wheel to the free end of a drive shaft provided on a carrier. The head extends from the print wheel toward a platen. The head lies in a space defined by the print wheel and a document guide device which is located between the platen and the print wheel and which guides a document downward in front of the platen. A document is not blocked by the mounting head while it is guided through the gap between the platen and the document guide device.

4 Claims, 6 Drawing Figures

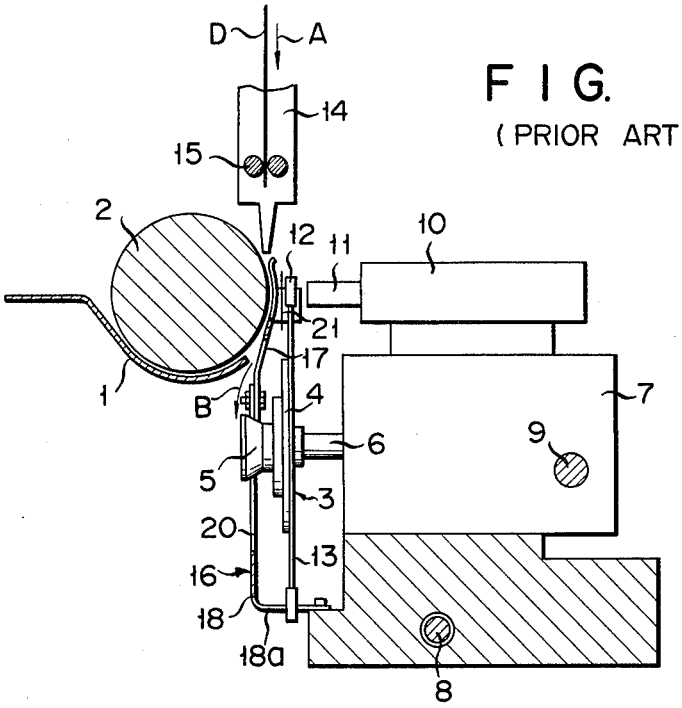
FIG. 1
(PRIOR ART)
FIG. 2
(PRIOR ART)
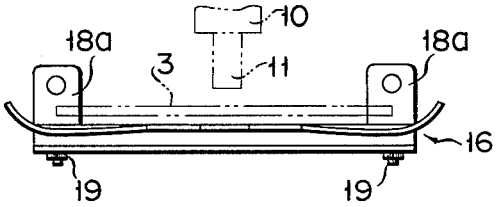
FIG. 3
(PRIOR ART)
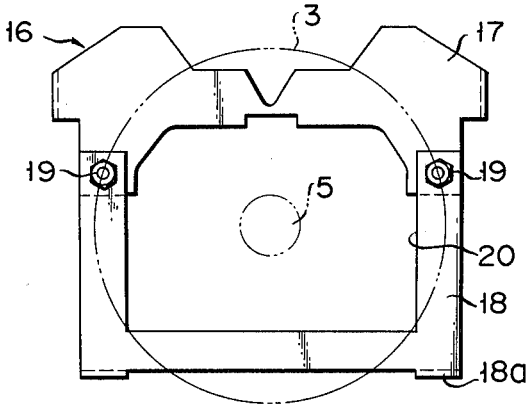

FIG. 4
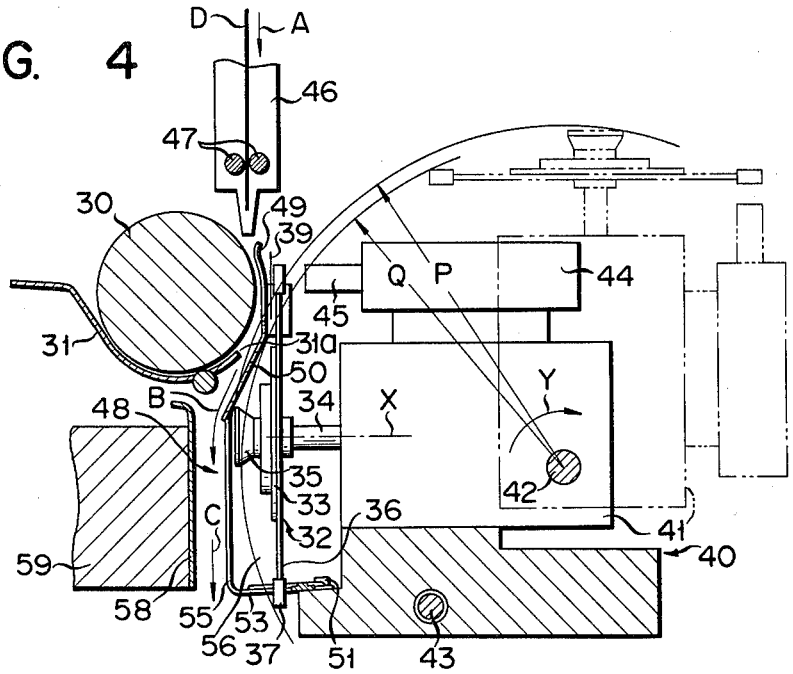
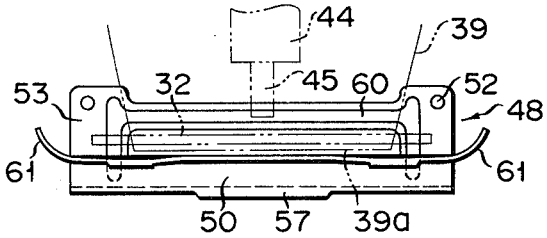
FIG. 5
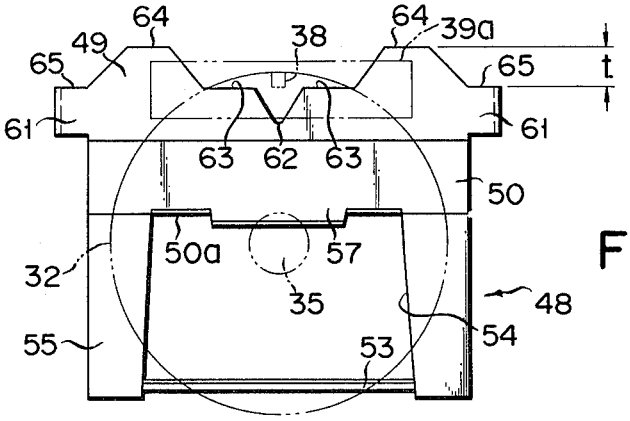
FIG. 6

PRINTER WITH A DOCUMENT GUIDE DEVICE

BACKGROUND OF THE INVENTION

This invention relates to a printer provided with a document guide device vertically disposed between a platen and a character-bearing print wheel.

This type of printer is attached as a printing device to a motor-driven drive shaft and is provided with a print wheel which is provided with a large number of flexible spokes extending in a radial direction from the central hub portion to which the drive shaft is attached. To the free end of each spoke is attached a character pad whose surface is provided with a character, and the character pads as a whole define the outer circumference of the wheel.

Printing papers are continuously and intermittently sent out towards the front of the platen from the rear of the platen, being guided by the paper guide located along the circumferential surface of the platen. Generally, continuous long papers are used as papers for printers. At a printing position, a character selected on the print wheel is struck onto a paper positioned at the front of the platen, by a hammer mechanism mounted on the carrier. In this way, printing is effected.

This type of printer is often provided with a mechanism to print on paper sheets like ledger sheets and cards by the print wheel, in addition to the ordinary mechanism for printing on long papers. These sheets are fed by an operator between the front of the platen and the print wheel from the top of the platen, using a document automatic feeding device, usually called an auto-inserter, installed on the top of the printer. With this mechanism, document sheets are lowered down to a desired position. Then, printing can be carried out, by the print wheel, on the desired parts of these sheets. For smooth insertion of these document sheets, a document guide device is located between the platen and the print wheel.

A printer provided with a conventional document guide device had a number of problems to be explained below. These problems will be explained together with a summary explanation of a printer of conventional structure.

In a printer disclosed in FIGS. 1 through 3, a character-bearing print wheel 3 faces the front of a platen 2 provided with a paper guide 1 for guiding ordinary printing papers. To a central hub portion 4 of the print wheel is attached the free end of a drive shaft 6 by means of a mounting head 5. The mounting head 5 projects towards the platen 2 side from the revolving plane of the print wheel. The drive shaft 6 is connected to a driving motor (not shown in the figures) installed on a carrier 7, and the motor selectively rotates the drive shaft 6 for character selection. The carrier 7 is supported by two parallel guide shafts 8, 9 and moves along the printing line to select printing positions. A hammer mechanism 10 is provided on the carrier 7, and a hammer 11 faces a character pad 12 of the print wheel 3. The wheel 3 has a large number of spokes 13 extending from the hub portion 4. On the free end of each spoke is mounted a character pad 12. On the surface of each pad 12 facing the platen is formed a character. The pads as a group define the outer circumference of the wheel 3. A printing ribbon 21 is disposed between the pad 12 and the platen 2.

As shown in FIG. 1, a document automatic feeding device 14 is mounted on the printer. The feeding device 14 feeds the document D down to a desired position as indicated by an arrow A from the top of the platen 2 through the front of the platen 2. A document guide device 16 is located vertically between the front of the platen 2 and the print wheel 3 to guide the document D. This guide device consists of a hard metal upper plate 17 and elastic lower plate 18 both of which are bolt-fixed, as shown in FIGS. 2 and 3, to form a window 20. A bent base section 18*a* of the device 16 is fixed to the carrier 7. The upper plate 17 is curved and extends along the circumference of the platen 2, as disclosed in FIG. 1. The lower plate 18 is almost vertically positioned to guide the document downwards.

The mounting head 5 also serves as a knob which an operator uses to attach or remove the print wheel 3, and is thus considerably big. The head 5, therefore, extends towards the platen side from the window 20 of the document guide device 16. As a result, it becomes impossible to feed documents, or documents fed are damaged because they are caught by the mounting head 5 as they are fed by the automatic feeding device 14 in the direction of an arrow.

Especially, when the print wheel of a printer has a vertical revolving plane, i.e., when the rotating axis of the drive shaft is horizontal, the mounting head is positioned closer to the document guide device, since the distance between the character pad and the platen is always limited to a specified short distance. In this type of the printer it is necessary to design the head to extend through the window of the device in order to avoid mutual interference by the head and the device. However, the structure for vertically positioning the revolving plane of the print wheel makes it possible to maintain the strength of the spokes since it is possible to use linear spokes for the print wheel, and simplifies design because of the use of a drive shaft with a horizontal rotating axis. It is, therefore, desired to solve problems related to document feeding while maintaining these merits.

U.S. Pat. No. 4,203,675, for instance, discloses an arrangement in which the rotating axis of the drive shaft is tilted and the revolving plane of the print wheel is thus tilted, too, to leave a larger distance between the mounting head and the platen. In this case, however, it is necessary to use bent spokes which are likely to be damaged in high speed rotation of the print wheel.

SUMMARY OF THE INVENTION

An object of this invention is to provide a printer having an improved document guide device which can prevent jamming of documents fed downwards and which can, therefore, guide documents smoothly.

According to this invention, the document guide device includes an upper plate section which faces the front side of the platen and guides documents inserted between the platen and the upper plate section, a slanted plate section which is connected to the upper plate section and extends downward with its plane slanted to the vertical plane, a base plate section and an intermediate plate section which is connected to the slanted plate section and the base plate section and extends vertically. The mounting head is enclosed by the slanted plate section and the intermediate plate section so that the mounting head is prevented from extending toward the platen. With this structure, the mounting head is completely accommodated in the vertical space between the document guide device and the rotating plane of the print wheel. Thus, the possibility of the document feeding path being blocked by the mounting head can be completely eliminated. Especially since the slanted plate section lies above the mounting head to prevent documents from coming into contact with the mounting head.

In a preferred embodiment of this invention, the document guide device consists of a single plate, resulting in further simplification of the device structure and in more smooth document guiding.

In the preferred embodiment, a carrier has a rockable part from a printing position to a rocked position around an axis. On the rockable part is mounted a drive shaft. As the rockable part rocks towards the rocked position, the print wheel and the drive shaft are also rocked within the vertical plane of the platen at right angles to the printing line. Here, the rocking radius of the print wheel is smaller than the rocking radius of the mounting head, and the print wheel does not interfere with the document guide device even if the print wheel rocks with the rockable part.

On the other hand, although the mounting head engages the rear side of the slanted plate section of the document guide device when it rocks, the document guide device, as it is flexible changes its shape and the slanted plate section is flexibly pushed out from the rocking locus of the mounting head when the above-mentioned engagement occurs. The characters on the print wheel thus would not be damaged by the document guide device when the rockable part of the carrier is rocked.

BRIEF DESCRIPTION OF THE DRAWINGS

FIG. 1 is a prior art schematic view of the printer;

FIG. 2 is a top view of the document guide device of the printer shown in FIG. 1;

FIG. 3 is a front view of the document guide device shown in FIG. 2;

FIG. 4 is a schematic view of a printer embodying this invention;

FIG. 5 is a top view of the document guide device of the printer disclosed in FIG. 4; and FIG. 6 is a front view of the document guide device shown in FIG. 5.

DETAILED DESCRIPTION OF THE PREFERRED EMBODIMENT

In the printer of a preferred embodiment of this invention as shown in FIGS. 4 through 6, a paper guide 31 is provided along a platen 30 for ordinary continuous papers (not shown). In front of the platen is rotatably disposed a character-bearing print wheel 32 within the vertical plane. The print wheel 32 is attached at its hub portion 33 located in the center to the free end of a drive shaft 34 having a horizontal rocking axis X, by means of a mounting head 35, and is removable. From the central hub portion 33 extend linear spokes 36 to a radial direction. On the tip of each spoke is mounted a character pad 37 and the character pads as a group define the outer circumference of the print wheel 32. A character is provided on that side of each pad 37 which faces the platen 30. The pad 37 at a printing position faces the platen 30 with a printing ribbon 39 between them.

The base part of the drive shaft 34 is mounted on a carrier 40. More specifically, the shaft 34 is coupled to the character selection driving motor (not shown) mounted in a rockable part 41 which forms part of the carrier 40. The carrier 40 is capable of linearly moving back and forth along the printing line of the platen on a pair of the parallel guide shafts 42 and 43. The rockable part 41 rocks around the axis of the guide shaft 42, as shown by an arrow Y from the printing position (solid line), within the vertical plane at right angles to the printing line, and is capable of moving as much as 90° to the rocked position. In rocking movement, the print wheel 32 and the drive shaft 34 rock together and, the mounting head 35 and the print wheel 32, or its outer circumference, each draw a rocking locus around the axis of the guide shaft 42 with rocking radius P, Q. One rocking radius P is larger than the other rocking radius Q.

The print wheel 32 is set to the rocked position when an operator replaces or cleans it.

On the rockable part of the carrier 40 is mounted a hammer mechanism 44 whose hammer 45 faces the rear of the pad 37 at a printing position. When the desired character pad 37 reaches the printing position, the hammer strikes the pad 37 with a specified timing to effect the printing of the character 38 on the paper on the platen 30 through the ribbon 39. The structure of the hammer mechanism 44 and the control of rotation of the print wheel 32 for character selection are similar to those of conventional printers, and are thus not detailed here as they are not important parts of this invention.

Documents D other than ordinary continuous papers are fed into the printing position, as shown by an arrow A, from the top of the platen 30 by means of a document automatic feeding device 46 mounted on the printer. The device 46 is provided with two feeding rollers 47, 47 which selectively rotate to lower the document D down to a desired position. The automatic feeding device 46 is not detailed here as a conventional one is employed.

A document guide device 48 is vertically located between the platen 30 and the print wheel 32 and is made of a single metal sheet. The device 48 consists of an upper plate section 49 curved along the circumference of the platen 30 for insertion of documents D, a slanted plate section 50 connected to the upper plate section 49 and extending downward and slantwise, a base plate section 53 extending in substantially horizontal direction and having fixing holes 52, through which the device 48 is fixed to the carrier 40 by means of bolts 51, an intermediate plate section 55 connected to the base plate section 53 and the slanted plate section 50 and consisting of a pair of leg members between them, which define an opening 54.

In a vertical space 56 defined by the slanted plate section 50 and the intermediate plate section 55 on one side and by the print wheel 32 on the other side is completely accommodated the mounting head 35 located at the printing position as shown in FIG. 4, and the tip of the head 35 does not interfere with the document guide device 48 or does not project toward the platen side.

At the center of the bottom edge **50*a* of the slanted plate section 50, i.e., in the region facing the mounting head 35 at the printing position, the slanted plate section 50 has an eaves member 57 which extends downward from the bottom edge 50*a*. The eaves member 57 further extends from the vertical plane in which the intermediate plate section 55 lies. That is, it extends away from the mounting head 53**.

The document D moves down in the direction of an arrow B and then along the upper plate section 49 and the slanted plate section 50. After reaching the bottom edge **50*a* of the slanted plate section 50, the document tends to extend in a vertical direction. But the eaves member 57 prevents at least that portion of the documents D which faces the mounting head 35 from extending in a vertical direction. Eventually, however, the lower part of the document D moves down in a vertical direction as shown by an arrow C, with its upper part held by the feeding device 46. In other words, the document D moves through a path, i.e. a gap between the left sides of the plate sections 49, 50 and 55 on one hand and an auxiliary guide plate 58 on the other. The auxiliary guide plate 58 is fixed to a frame 59 and substantially parallel to the intermediate plate section 55. The auxiliary guide plate 58** may be omitted.

Since the mounting head 35 is completely separated from the document path when located at the printing position, the document D is not blocked or damaged.

As mentioned above, the intermediate plate section 55 has the opening 54. This saves material and helps to increase the elasticity of the device 48. Unlike conventional devices, opening 54 does not serve as a window. That is, the opening 54 is not cut to allow passage of the mounting head.

The opening 54 is cut partly in the base plate section 53. On the base plate section 53 a rib 60 is formed around the opening 54, thus reinforcing the document guide device. The base plate section 53 is firmly fixed to the carrier 40, and the other plate sections 49, 50 and 55 may be easily bent unlike the base plate section 53.

To replace the print wheel with another the rockable part 41 is moved to the rocked position. The mounting head 35 then comes into engagement with the rear of the slanted plate section 50 because the section 50 lies within the rotation locus of the mounting head 35. The mounting head 35, however, pushes the section 50 out of the rotation locus, assisted by the elasticity of the document guide device. On the other hand, the print wheel 32 does not contact the document guide device 48 as it rotates, drawing a locus of the largest radius Q. Therefore, there is no fear that the character pads 37 will be damaged while the print wheel is rocking and moving toward the rocked position.

The document guide device according to the invention can smoothly guide a journal paper. The paper guide 31 smoothly guides a journal paper as long as the slanted plate section 50 stays in a position where it faces the paper-feeding end 31*a* of the paper guide 31.

The upper plate section 49 comprises bent end pieces 61 and a middle portion integral with the end pieces 61. The middle portion has a V-notch 62 which allows the spokes of the print wheel to bend toward the platen. The middle portion further has two first horizontal edges 63 which are symmetrical with respect to the V-notch 62 and which indicate a first printing line. The middle portion further has two second horizontal edges 64 which are symmetrical with respect to the V-notch 62 and which indicate a second printing line above the first printing line. The bent end pieces 61 have a third horizontal edge 65 each. Both third horizontal edges 65 are symmetrical with respect to the V-notch which are aligned with the first horizontal edges 63.

The first horizontal edges 63 and the third horizontal edges 65 are aligned with the lower edge of the character 38 which lies in the printing position, as illustrated by a chain line in FIG. 6. A line of characters already printed can thus be easily brought into alignment with the first or second printing line, merely by moving the paper in vertical direction. The distance t between the first printing line and the second printing line is, for example, $\frac{1}{3}$ inch or $\frac{1}{2}$ inch.

A cassette containing an endless ribbon is usually used in this type of printer. The unrolled, straight portion 39*a* of a ribbon 39 lies close to the platen 30 as shown in FIGS. 5 and 6. The first horizontal edges 63 are hidden behind the straight portion 39*a* of the ribbon 39. The operator could not see where the first printing line lies if the third horizontal edges 65 were not provided. Either third horizontal edge is always seen.

What we claim is:

1. A printer comprising:

a platen;

a character-bearing print wheel having a central hub portion, a plurality of substantially straight spokes radially extending from said central hub portion in the same vertical plane respectively, and a plurality of character pads fixed to the respective free ends of said spokes and defining the outer diameter of the print wheel;

a horizontally extending drive shaft attached to said central hub portion of said print wheel for rotating said print wheel, said drive shaft having a free end portion;

carrier means rotatably supporting said drive shaft;

a mounting head for fixing said print wheel to said free end portion of said drive shaft, said mounting head extending from said print wheel toward said platen; and a document guide device defining a document path in association with the platen, said document guide device allowing a document to pass downward through the document path;

said document guide device including an upper plate section disposed between said platen and said character pads of said print wheel and curved along the circumference of said platen for insertion of the document, a slanted plate section connected to said upper plate section at the upper end thereof and extending downward and slanted relative to said upper plate section and towards said platen, a lower base plate section fixed to said carrier means, and an intermediate plate section disposed substantially vertically and connected to the lower end of said slanted plate section at the upper end thereof and to said lower base plate section at the lower end thereof; and said slanted plate section and intermediate plate section defining in association with said print wheel a space within which said mounting head is accommodated, whereby said mounting head is completely separated from said document path.

2. The printer of claim 1, wherein said document guide device is made of a single metal sheet.

3. The printer of claim 1 or 2, wherein said document guide device has elasticity; said carrier means includes a pivotable part on which said drive shaft is mounted and which is adapted to pivot together with said print wheel around a pivot axis in a substantially vertical plane substantially perpendicular to a printing line of said platen from a printing position in which said drive shaft is horizontally held to a pivoted position; said pivot axis being so positioned that when said pivotable part pivots, said print wheel does not come into contact with said document guide device, while said mounting head comes into engagement with said slanted plate section to push said slanted plate section and disengage there-from, assisted by said elasticity of said document guide device.

4. The printer of claim 1 or 2, wherein said upper plate section includes a middle portion having a substantially V-notch, a pair of first horizontal edges which are symmetrical with respect to said V-notch and which indicate a first printing line, and a pair of second horizontal edges which are symmetrical with respect to said V-notch and which are provided outside said first edges respectively, said second edges indicating a second printing line above said first printing line; and said upper plate section further includes a pair of bent end pieces projecting substantially horizontally in opposite directions from said middle portion, said bent end pieces having third horizontal edges which are symmetrical with respect to said V-notch and which are aligned with said first horizontal edges respectively.

* * * * *

UNITED STATES PATENT AND TRADEMARK OFFICE

CERTIFICATE OF CORRECTION

PATENT NO. : 4,423,971

DATED : January 3, 1984

INVENTOR(S) : Yutaka HIRA et al

It is certified that error appears in the above-identified patent and that said Letters Patent is hereby corrected as shown below:

COLUMN 5, line 60, after "the V-notch" delete "which" and insert --62 and are--.

Signed and Sealed this

*Seventh* Day of *August 1984*

[SEAL]

*Attest:*

GERALD J. MOSSINGHOFF

*Attesting Officer*

*Commissioner of Patents and Trademarks*